US006306110B1

(12) United States Patent
McElhannon

(10) Patent No.: US 6,306,110 B1
(45) Date of Patent: Oct. 23, 2001

(54) WATER POWERED MASSAGER

(76) Inventor: Kenneth D. McElhannon, 323 Baker St., Pickens, SC (US) 29671

( * ) Notice: Subject to any disclaimer, the term of this patent is extended or adjusted under 35 U.S.C. 154(b) by 0 days.

(21) Appl. No.: 09/290,729

(22) Filed: Apr. 12, 1999

(51) Int. Cl.[7] ..... A61H 9/00

(52) U.S. Cl. ..... 601/160; 601/169; 601/159; 601/155; 601/75

(58) Field of Search ..... 601/160, 154, 601/155, 159, 169, 55, 75, 76

(56) References Cited

U.S. PATENT DOCUMENTS

| | | | | |
|---|---|---|---|---|
| 890,709 | * | 6/1908 | Richwood | 601/75 |
| 1,005,024 | | 10/1911 | Griner . | |
| 1,780,876 | | 11/1930 | Grosse . | |
| 2,646,039 | | 7/1953 | Agosti | 128/64 |
| 3,720,204 | | 3/1973 | Wojtowicz | 128/64 |
| 3,848,607 | | 11/1974 | St. Clair | 128/400 |
| 3,924,808 | | 12/1975 | Cooley, Jr. | 239/102 |
| 4,084,271 | | 4/1978 | Ginsberg | 4/161 |
| 4,179,765 | | 12/1979 | Teague, Jr. et al. | 15/22 R |
| 4,336,622 | | 6/1982 | Teague, Jr. et al. | 15/22 R |
| 4,635,619 | | 1/1987 | Diamond | 128/39 |
| 4,926,510 | | 5/1990 | Watkins | 4/542 |
| 5,074,286 | | 12/1991 | Gillaspie et al. | 128/33 |
| 5,187,827 | * | 2/1993 | Wei | 601/75 |
| 5,503,618 | | 4/1996 | Rey | 601/15 |
| 5,738,638 | | 4/1998 | Henkins et al. | 601/148 |
| 5,788,160 | | 8/1998 | Woog | 239/282 |

* cited by examiner

*Primary Examiner*—Michael A. Brown
*Assistant Examiner*—Benjamin K. Koo
(74) *Attorney, Agent, or Firm*—Oscar A. Towler, III; Hardaway/Mann IP Group

(57) ABSTRACT

A water powered massager 10 comprised of a diviter valve 30 connected to a shower head 20 that diverts water into a hose 40 having an inlet channel 180 and an outlet channel 190 and is connected to a body 60. The water flows from the diviter valve 30, through the inlet channel 180 and into the body 60. Within the body 60 is a propeller 210 inside a propeller cavity 230. As water is introduced into the propeller cavity 230 from the inlet channel 180, it turns the propeller 210 and then exits the propeller cavity 230 back into the hose 40 in the outlet channel 190. The water travels through the outlet channel 190 back to the diviter valve and out to the nozzle 300 of the shower head 20. A flex plate 80 is attached to the body 60 and vibrates as a result of the water inside the propeller cavity 230. As the propeller 210 turns due to the force of the water, it rotates a central pin 220 which in turn rotates a rotating disk 160. The rotating disk 160 is adjacent to and in communication with a pulsating disk 150. As the rotating disk 160 rotates, it causes the pulsating disk 150 to pulsate. A flex plate 80 is connected to the pulsating disk 150 and as the pulsating disk 150 pulsates in a back-and-forth fashion, it causes the flex plate 80 to pulsate also. The pulsating action of the flex plate 80 can be used to massage a person's body.

7 Claims, 2 Drawing Sheets

WATER POWERED MASSAGER

BACKGROUND OF THE INVENTION

1. Field of Invention

The present invention relates to a hand held body massager, more particularly to a massager that is powered with water from a supply source such as a shower head.

2. Description of Prior Art

Other massagers in the art are similar, but lacking in some capacity are listed below.

The U.S. patents issued to Henkin et al. (U.S. Pat. No. 5,738,638), Watkins, (U.S. Pat. No. 4,926,510), Diamond (U.S. Pat. No. 4,635,619), Agosti (U.S. Pat. No. 2,646,039) and Grosse (U.S. Pat. No. 1,780,876) all disclose massage units that use membranes with water impacting the membranes to form the massaging effect. The U.S. Patent issued to Griner (U.S. Pat. No. 1,005,024) discloses a water powered massager that is powered by water. However, the Griner device employs an applicator that turns in a circular motion as the massaging unit instead of a pulsating action.

While the above stated devices are a fair representation of the current prior art, there remains room for improvement as defined by the currently claimed invention.

SUMMARY OF THE INVENTION

An objective of the present invention is to provide a massager that can be powered by the water.

Another objecting of the present invention is to provide a massager that can be attached to a conventional shower head assembly.

Yet another objective of the present invention is to provide a massager that is easy to use, convenient and inexpensive.

Still yet another objective of the present invention is to provide a massage unit that pulsates and is movable.

And another objective of the present invention is to provide a massager that can have pads of various materials such as cloth, sponge, loofah and nylon mesh attached for a more pleasurable massage.

The objectives of the present invention will be satisfied by the water powered massager that has a diviter valve connected to a shower head that diverts water into a hose having an inlet channel and an outlet channel and is connected to a body. The water flows from the diviter valve, through the inlet channel and into the body. Within the body is a propeller inside a propeller cavity. As water is introduced into the propeller cavity from the inlet channel, it turns the propeller and then exits the propeller cavity back into the hose in the outlet channel. The water travels through the outlet channel back to the diviter valve and out to the nozzle of the shower head. A flex plate is attached to the body and vibrates as a result of the water inside the propeller cavity. As the propeller turns due to the force of the water, it rotates a central pin which in turn rotates a rotating disk. The rotating disk is adjacent to and in communication with a pulsating disk. As the rotating disk rotates, it causes the pulsating disk to pulsate. A flex plate is connected to the pulsating disk and as the pulsates disk pulsates, it causes the flex plate to pulsate also. The pulsating action of the flex plate can be used to massage a person's body.

Also, the aforementioned objectives will be accomplished as well as other features and advantages of the present invention will become more apparent from the following detailed description. The description of the present invention discloses, in conjunction with the drawings which illustrate by way of example, the principles and objects of the invention.

BRIEF DESCRIPTION OF THE DRAWINGS

The features of the present invention will become apparent to those skilled in the art to which the present invention relates from the following specification with reference to the accompanying drawings in which.

DETAILED DESCRIPTION OF THE INVENTION

Figure 1:
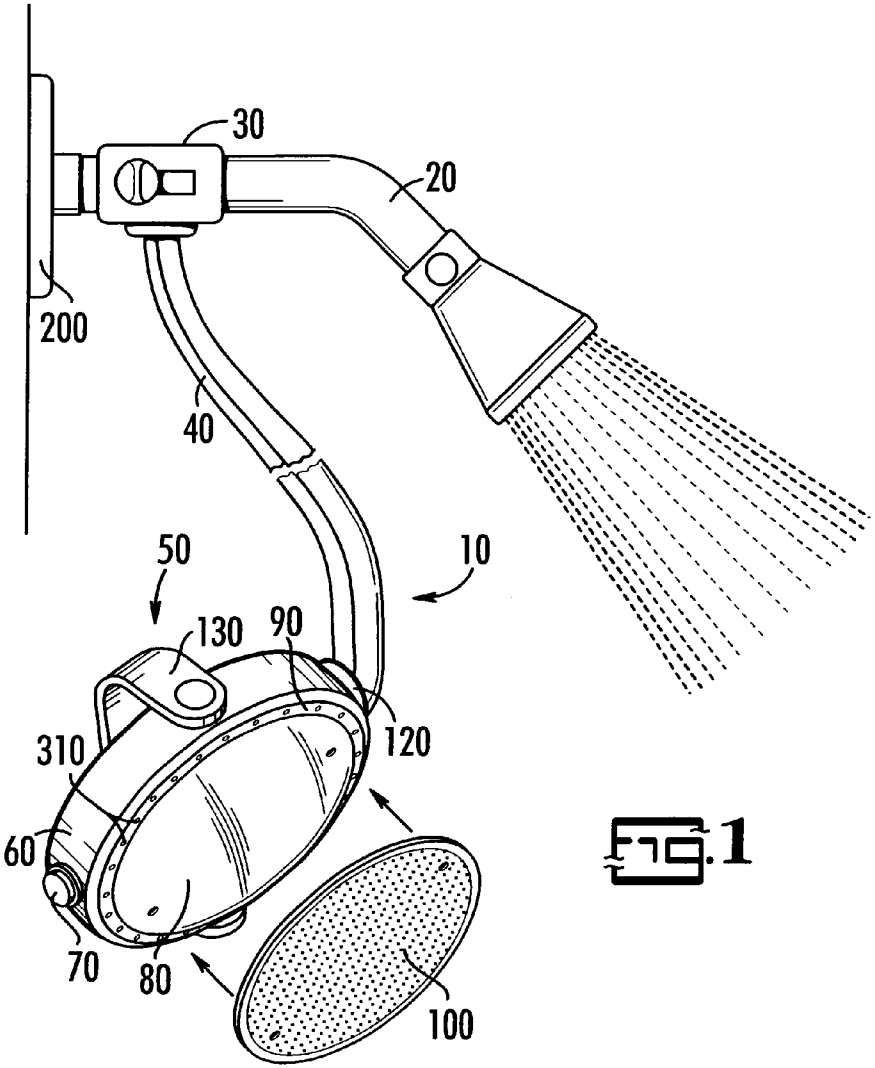
FIG. 1 is a perspective view of a massager connected to a shower head.

FIG. 1 is a perspective view of the water powered massager 10. The water powered massager 10 is connected to a shower head 20 by a diviter valve 30. The diviter valve 30 can be switched to control the flow of water either to the shower heat 20 or too the water powered massager 10. The diviter valve 30 is located near the support 200 of the shower head 20 and is connected to a hose 40 which is then connected to the massage unit 50 of the water powered massager 10. The body 60 of the water powered massager 10 has a joint 120 into which the hose 40 is connected to. The body 60 also has a handle 130 to make holding and maneuvering the water powered massager 10 easy and convenient. The body 60 also has a flex plate 80 that is secured to the body 60 with a flex plate retainer ring 90 that encircles the perimeter of the flex plate 80. The flex plate retainer ring 90 holds a gasket 140 (not shown) that is flexible, pliable and durable. The gasket 140 allows for the flex plate 80 to vibrate while maintaining a sealed body 60 so the water inside the body 60 does not escape. The flex plate 80 vibrates when the water powered massager 10 is in use creating a massaging effect. The body 60 may have an optional button 70 located thereon. The button 70 controls the escape of water from within the body 60 of the water powered massager 10. When the button 70 is depressed, water is allowed to escape or exit the body 60 through a series of spray apertures 310 that are placed surrounding the perimeter of the flex plate 80 or any convenient location on the body 60. The water spraying from the spray apertures 310 can be used to wash while the water powered massager 10 is being used. A pad 100, made of any material such as cloth, sponge, loofah or nylon mesh, can also be attached to the body 60 with connecting means 110. The connecting means is located on the flex plate 80 or may be located somewhere else on the body 60 of the water powered massager 10.

Figure 2:
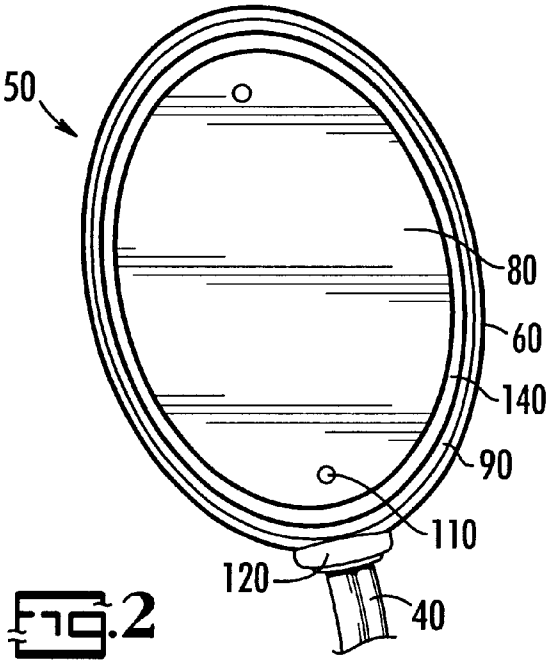
FIG. 2 is a top plan view of a massager head.

FIG. 2 is a plan view of the massage unit 50 of the watered powered massager 10. The hose 40 comes into a joint 120 on the body 60. The body encompasses a flex plate retainer ring 90 which surrounds a rubber seal that is able to expand and contract while the flex plate 80 vibrates, yet seals the area between the flex plate 80 and body 60 thus preventing any fluids with the water powered massager 10 from escaping the flex plate 80 is the portion of the water powered massager 10 that vibrates or pulsates in an up-and-down fashion when in use.

Figure 3:
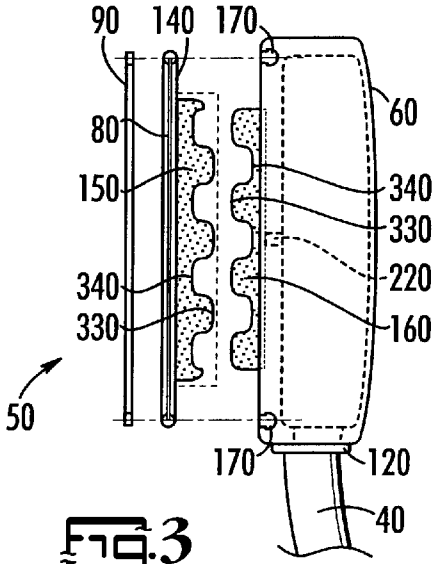
FIG. 3 is an exploded view of the massager head.

FIG. 3 is a broken-away exploded view of the massage unit 50 of the water powered massager 10. The hose 40 comes into and is connected to the body 60 at the joint 120. The body 60 has a hollow interior within the internal works or motor 280 (V in FIG. 5) are housed. The body 60 has a channel or groove 170 that runs the perimeter on one side and is shaped to accept the gasket 140 and the flex plate retainer ring 90 therein forming a seal to the water powered massager. The gasket 140 is connected to the flex plate 80. The gasket 140 is made of rubber, plastic or any other water impermeable material that is flexible, pliable and durable. The gasket 140 and flex plate retainer ring 90 are layered within the channel 170 to seal the water powered massager 10 as well as holding the flex plate 80 in place within the body 60. Also connected to the same side of the body 60 as the channel 170 is a rotating disk 160. The rotating disk 160 is connected to the motor 280 (FIG. 5) within the body 60 by a central pin 220. Attached to one side of the flex plate 80, the side closest to the body 60 is a pulsating disk 150. Both the rotating disk and the pulsating disk 150 are comprised of a series of nodules 330 and recessions 340. It is the mating relationship of the two disks 150, 160 along with the rotating nature of the rotating disk that create the vibrating effect of the flex plate 80 and will be described in greater detail as follows.

Figure 4:
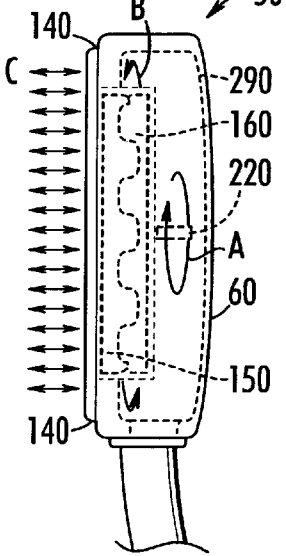
FIG. 4 is a sectional view of the massager head.

FIG. 4 is a broken-away sectional view of the massage unit 50 of the water powered massager 10. The motor housing 290, shown in dashed lines in the body 60, turns a central pin 220 when the water powered massager 10 is in use. The central pin 220 is connected to the back side of the rotating disk 160. When the central pin 220 is rotated in the direction of arrow A, the rotating disk 160 is in turn rotated in the direction of arrow B. With the flex plate retainer ring 90 snapped into groove 170 thus holding the gasket 140 and flex plate 80 securely in place, they in turn hold the pulsating disk 150 in a mating fashion next to and abutted up against the rotating disk 160. As the rotating disk 160 rotates due to the turning of the central pin 220, the nodules 330 of the rotating disk 160 rub against the nodules 330 of the pulsating disk 150 causing the pulsating disk 150 to push away from the rotating disk 160. The pulsating disk 160 is free to move because of the flexible, elastic nature of the gasket 140. The gasket 140 expands when the pulsating disk 150 is pushed away from the rotating disk 160 and the gasket 140 constricts when the pulsating disk 150 settles close to or back near the rotating disk 160. As the nodules 330 of the two disks 150, 160 meet one another forcing the two disks apart, the rotating disk 160 continues to rotate and the nodules of the rotating disk eventually glide into the recessions 340 of the pulsating disk 150 and the nodules 330 of the pulsating disk 150 slide into the recessions 340 of the rotating disk 160 allowing both disks to nestle together in a mating fashion. When both disks 150, 160 are nestled close together, the gasket 140 is able to constrict and hold the pulsating disk 150 close to the rotating disk 160. As the motor 280 continues to rotate in the direction of arrow A, causing the rotating disk 160 to rotate in the direction of arrow B, the flex plate 80 pulsates back-and-forth in an in-and-out fashion as depicted by arrows C. The pulsating movement of the flex plate 80 is caused by the continuous rise and fall of the pulsating plate 150 against the rotating plate 160 as the nodules 330 on both plates 150, 160 as the nodules 330 on both plates 150, 160 transverse one another until they nestle into the recessions 340 of each plate 150, 160. This pulsating motion continues while the water powered massager 10 is in use and is caused by the movement of water through the motor 280.

Figure 5:
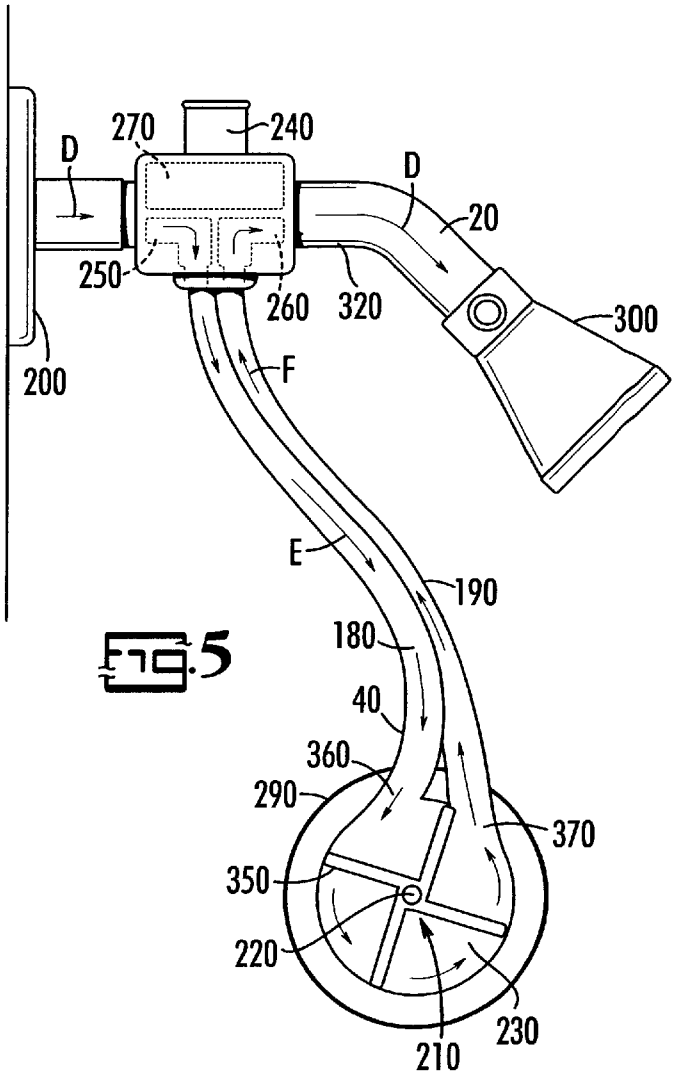
FIG. 5 is a sectional view of the massager as connected to the shower head showing the motor and hose elements.

FIG. 5 is a broken-away sectional view of the water powered massager 10 with the motor housing 290 that has been removed from the body 60 (not shown). The water powered massager 10 can be used with a conventional shower head 20 comprised of a spray nozzle 300 attached to a support 200 with a pipe 320. Located on the pipe 320 between the support 200 and nozzle 300 is a diviter valve 30 that controls the water passing therethrough. As water enters the pipe 320 from the plumbing system within a building or similar structure, it passes through the diviter valve 30 and either flows directly to the nozzle 300 or to the body 60 of the water powered massager 10. The diviter valve 30 has a channel button 240 that can be moved between a number of positions. In a first position, the channel button 240 is depressed into the diviter valve 30, a direct port 270 guides the water flowing from the support 200 directly through the diviter valve 30 in the direction of arrow D to the spray nozzle 300, allowing the shower head 20 to function in a conventional manner.

In a second position, the channel button 240 is either pushed, pulled or turned which causes the water flowing from the support 200 area of the shower head 20 in direction of arrow D to enter an inlet port 250, pass through the hose 40 through the water powered massager 10, back into the hose 40, though an outlet port 260 and finally out through the nozzle 300. The inlet port 250 in the diviter valve 30 is an L-shaped channel that directs the flow of water from a direct path to the nozzle 300 to a diverted path through the water powered massager 10. While in the preferred embodiment both the inlet and outlet ports 250, 260 are L-shaped, they can take on any variety of shapes necessary to divert the flow of water into the desired path. When the water from the support 200 enters the diviter valve 30, it is directed through the inlet port 250 to enter an inlet channel 180 in the hose 40. The hose 40 is divided into two channels: an inlet channel 180 and an outlet channel 190. The water enters the inlet channel 180 of the hose 40 from the inlet port 250 and travels in the direction on arrow E until it approaches the motor housing 290 that is located within the body 60 of the water powered massager 10. As the water enters the motor housing 290, the inlet channel 180 narrows in diameter causing the water to enter the motor housing 290 at a higher pressure than it is at as it flows through the inlet channel 180. The water enters the motor housing 290 into a propeller cavity 230 where it begins to flow in a circular pattern until exiting the propeller cavity 230 into the outlet channel 190. The propeller cavity 230 is circular or oblong in shape thus forcing the water that enters into it to move in a circular manner. Also located within the propeller cavity 230 is a propeller 210 having numerous arms 350 that radiate out from and rotate around the central pin 220. The central pin 220 is connected at one side to the propeller 210 at the opposite end to the rotating disk 160. As the propeller 210 turns due to the water in the propeller cavity 230 pushing against the arms 350, the central pin 220 rotates causing the rotating disk 160 to rotate also. The water enters the propeller cavity 230 in the area between two propeller arms 350. As a propeller arm 350 rotates past an inlet opening 360 where the inlet channel 180 is connected to the propeller cavity 230, the water is free to enter the propeller cavity 230 unobstructed. As an arm 350 passes the inlet opening 360 it temporarily closes off the inlet opening 360 until the arm has rotated past the inlet opening 360. Immediately after an arm 350 has rotated past the inlet opening 360, the water in inlet channel 180, which is at a higher pressure due to the narrowing of the inlet channel 180 at this location, pushes against the propeller arm 350 causing it to move or rotate around the central pin 220. This action continues with each propeller arm 350 as long as water is supplied to the water powered massager 30. As the water flows around the inside of the propeller cavity 230 pushing the propeller 210, it eventually reaches an outlet opening 370 that is located where the outlet channel 190 of the hose 40 is connected to the propeller cavity 210. As with the inlet opening 360, when a propeller arm 350 crosses the outlet opening 370 it temporarily shuts the outlet opening 370 off preventing any water from escaping the propeller cavity. However, as the arm 350 rotates past the outlet opening 370, water is allowed to escape the propeller cavity 230 and enter the outlet channel 190 of the hose 40 where it is directed back in the direction of arrow F to the diviter valve 30 and out to the nozzle 300. As the water flows through the hose 40 into the propeller cavity 230, it causes the propeller 210 to rotate which rotates the central pin 220 that in turn rotates the rotating disk 160 that causes the pulsating disk 150 to pulsate back and forth, hence powering the water powered massager 10.

The water powered massager 10 described herein and illustrated in the drawings is subject to other advantages and modifications that may be apparent to those of ordinary skill in the art without departing from the spirit and scope of the appended claims. Accordingly, the invention is to be limited only by the scope of the following claims and their equivalents.

What is claimed is:

1. A water powered massager for connecting to a shower head assembly comprising:

a massage unit comprising:

a body, a connection joint connected to said body, a handle for said body, a flex plate, a flex plate retainer ring, a rotating disc, and a pulsating disc, said pulsating disc attached to said flex plate, wherein said body comprises a propeller within a propeller cavity, a central pin connected at one end to the center of said propeller and connected at the other end to said rotating disc, said body further comprising a channel groove within which said flex plate retainer ring matingly fits, said flex plate comprising a flexible plate and a gasket connected to and surrounding a perimeter edge of said flexible plate, said gasket being retained to said body by said flex plate retainer ring;

a shower head assembly, said assembly comprising a diverter valve, said diverter valve comprising a channel button, a direct port, an inlet port, and an outlet port, wherein when said channel button is in a first position water flows through said direct port and when said channel button is in a second position water flows through said inlet port;

a hose connecting said connection joint with said diverter valve, said hose comprising an inlet channel and an outlet channel each connected at one end thereof to said body through said connection joint, said inlet channel connected at one end thereof to said inlet port and connected at the other end to said connection joint whereby water flows from said inlet port into said propeller cavity, said outlet channel connected at one end thereof to said outlet port and connected at the other end to said connection joint whereby water flows from said propeller cavity to said outlet port;

wherein said rotating disc and said pulsating disc are held in abutting contact; and wherein said rotating disc has a plurality of nodules and recessions; said pulsating disc has a plurality of nodules and recessions; said nodules and recessions of said rotating disc corresponding with said recessions and nodules of said pulsating disc;

wherein when said rotating disc rotates, said nodules and recessions of said rotating disc interact with said nodules and recessions of said pulsating disc causing said flex plate to move toward said body as said nodules fall within said recessions on the respective discs and then as the rotating disc is rotated further, said nodules of said rotating disc abut said nodules of said pulsating disc causing said flex plate to move away from said body and pulsate back and forth, said pulsating capable of massaging.

2. The water powered massager of claim 1, wherein:

water entering said propeller cavity from said inlet channel of said hose moves said propeller;

said propeller moves said central pin;

said central pin moves said rotating disk;

said rotating disk moves said pulsating disk; and said pulsating disk moves said flex plate;

wherein the movement of said flex plate is used to massage.

3. The water powered massager of claim 2, wherein:

said propeller has a plurality of arms that are pushed by water entering, moving within and exiting said propeller cavity causing said propeller to rotate.

4. The water powered massager of claim 3, wherein:

said body has a button and a plurality of apertures for allowing water to exit said massage unit;

wherein when said button is depressed, water escapes from said body through said plurality of apertures allows a person using said water powered massager to spray water out of the massage unit.

5. The water powered massager of claim 4, wherein:

said body has a connecting means for a pad to be connected to said flex plate of said massage unit; and a pad connected to said massage unit.

6. The water powered massager of claim 5, wherein:

said pad is cloth.

7. A water powered massager for use with a shower head assembly comprising:

a valve having a plurality of ports for directing water to both a shower head and said water powered massager as it flows through the shower head assembly;

a massage unit having a flex plate with a gasket connected to and surrounding the perimeter of said flex plate, a flex plate retainer ring for holding said gasket and flex plate in position, a body having a groove for snapping said flex plate retainer ring into and hold therein wherein said gasket lies between said flex plate retainer ring and said groove when said flex plate retainer ring is snapped into place within said groove and said body having a propeller inside a propeller cavity;

a rotating disk connected to said body and said propeller;

a pulsating disk connected to said flex plate and adjacent said rotating disk; and a hose connected to said massage unit, said hose having an inlet channel for water flowing into said massage unit, said inlet channel of said hose having a gradually decreasing diameter near said massage unit causing water flowing through said inlet channel to increase in speed as it enters said propeller cavity within said body; and an outlet channel for water flowing out of said massage unit, whereby said water in said propeller cavity pushes against a plurality of arms on said propeller causing said propeller to rotate around a central pin connected to the center of said propeller and said water exits said propeller cavity through said outlet channel, said central pin is connected to said rotating disk and the rotation of said propeller rotates said central pin, said central pin rotates said rotating disk; and wherein said rotating disk has nodules and depressions and said pulsating disk has corresponding depressions and nodules wherein when said nodules of said rotating disk are nestled within the depressions of said pulsating disk, said pulsating disk is pulled next to said rotating disk and when said rotating disk rotates the nodules of both disks rotate out of said depressions until the nodules of said rotating disk are touching the nodules of the pulsating disk causing said pulsating disk to push away from said rotating disk and said pushing and pulling motions form the pulsating action that massages.

* * * * *